US012012264B2

(12) United States Patent
Hofmann et al.

(10) Patent No.: US 12,012,264 B2
(45) Date of Patent: Jun. 18, 2024

(54) WATER BOTTLE

(71) Applicant: Dick's Sporting Goods, Inc., Coraopolis, PA (US)

(72) Inventors: Craig Francis Hofmann, Pittsburgh, PA (US); Anthony Joseph Koch, McKees Rocks, PA (US); Chinawut Paul Paesang, Sewickley, PA (US); Casper Adam Crouse, IV, Coraopolis, PA (US)

(73) Assignee: Dick's Sporting Goods, Inc., Coraopolis, PA (US)

( * ) Notice: Subject to any disclaimer, the term of this patent is extended or adjusted under 35 U.S.C. 154(b) by 0 days.

(21) Appl. No.: 17/808,308

(22) Filed: Jun. 23, 2022

(65) Prior Publication Data

US 2023/0040658 A1 Feb. 9, 2023

Related U.S. Application Data

(60) Provisional application No. 63/229,291, filed on Aug. 4, 2021.

(51) Int. Cl.

| | |
|---|---|
| ***B65D 51/18*** | (2006.01) |
| ***A45F 3/18*** | (2006.01) |
| ***A47G 21/18*** | (2006.01) |
| ***B65D 1/02*** | (2006.01) |
| ***B65D 43/16*** | (2006.01) |
| ***B65D 47/06*** | (2006.01) |
| ***B65D 47/30*** | (2006.01) |
| ***B65D 51/24*** | (2006.01) |

(52) U.S. Cl.

CPC ..... *B65D 51/18* (2013.01); *A45F 3/18* (2013.01); *A47G 21/18* (2013.01); *B65D 1/0246* (2013.01); *B65D 43/161* (2013.01); *B65D 47/065* (2013.01); *B65D 47/305* (2013.01); *B65D 51/242* (2013.01); *B65D 2251/0025* (2013.01); *B65D 2251/0084* (2013.01); *B65D 2251/1058* (2013.01); *B65D 2517/0049* (2013.01); *B65D 2543/00046* (2013.01)

(58) Field of Classification Search

CPC ..... B65D 51/18; B65D 2251/1033; B65D 43/161; B65D 2251/1058; B65D 2543/00046; B65D 47/305; B65D 2517/0049; B65D 47/065; A47G 21/18

See application file for complete search history.

(56) References Cited

U.S. PATENT DOCUMENTS

| | | | | |
|---|---|---|---|---|
| 5,065,909 | A * | 11/1991 | Pino | B65D 47/305 222/536 |
| 5,150,815 | A | 9/1992 | Saklad | |
| 5,971,202 | A | 10/1999 | Filbrun | |
| 7,533,783 | B2 | 5/2009 | Choi et al. | |
| D638,658 | S | 5/2011 | Staton | |

(Continued)

*Primary Examiner* — Nathan J Jenness
*Assistant Examiner* — Jennifer Castriotta
(74) *Attorney, Agent, or Firm* — Foley & Lardner LLP

(57) ABSTRACT

A water bottle is disclosed. The water bottle has a reservoir that defines a space for holding a liquid, wherein the reservoir comprises an open top and a closed bottom. The water bottle also has a lid that is configured to engage with the reservoir over the open top. The water bottle also has a straw, and a pivotable mouthpiece that is attached to the lid and that comprises a fluid conduit that is fluidly connected to the straw.

20 Claims, 7 Drawing Sheets

(56) References Cited

U.S. PATENT DOCUMENTS

D649,879 S 12/2011 Gullickson et al.
D652,256 S 1/2012 Eyal
8,191,727 B2 6/2012 Davies et al.
D682,034 S 5/2013 El-Saden et al.
D685,606 S 7/2013 Keys et al.
D686,448 S 7/2013 Boroski
D686,877 S 7/2013 Ortega
8,602,238 B2 12/2013 El-Saden et al.
8,622,237 B2 1/2014 Choi et al.
8,668,106 B1 * 3/2014 Joy ..... A47G 19/2272 220/717
8,777,048 B2 7/2014 Choi et al.
D724,384 S 3/2015 Donovan et al.
D732,892 S 6/2015 Keys et al.
9,162,802 B2 10/2015 El-Saden et al.
D750,428 S 3/2016 Keys et al.
9,392,893 B2 * 7/2016 Sorensen ..... B65D 47/06
9,463,911 B2 10/2016 Choi et al.
D774,363 S 12/2016 Seiders et al.
D774,837 S 12/2016 Seiders et al.
D781,662 S 3/2017 Seiders et al.
D784,775 S 4/2017 Seiders et al.
D787,893 S 5/2017 Seiders et al.
D787,894 S 5/2017 Seiders et al.
9,708,107 B2 7/2017 El-Saden et al.
D795,019 S 8/2017 Seiders et al.
D799,320 S 10/2017 Goodwin et al.
D799,906 S 10/2017 Seiders et al.
D799,908 S 10/2017 Seiders et al.
9,782,028 B2 10/2017 Davies et al.
D802,993 S 11/2017 Joseph et al.
D803,632 S 11/2017 Seiders et al.
9,820,595 B2 11/2017 Davies et al.
D804,254 S 12/2017 Seiders et al.
D804,255 S 12/2017 Seiders et al.
D804,256 S 12/2017 Seiders et al.
D807,125 S 1/2018 Seiders et al.
D807,126 S 1/2018 Seiders et al.
D808,711 S 1/2018 Joseph et al.
D808,713 S 1/2018 Rane et al.
D810,502 S 2/2018 Joseph et al.
D811,162 S 2/2018 Rane et al.
D811,810 S 3/2018 Joseph et al.
D812,970 S 3/2018 Rane et al.
D814,855 S 4/2018 Hammer
D818,774 S 5/2018 Stover
D819,410 S 6/2018 Seiders et al.
D820,637 S 6/2018 Davis
D821,809 S 7/2018 Rane et al.
D823,646 S 7/2018 Seiders et al.
D824,218 S 7/2018 Seiders et al.
10,023,365 B2 7/2018 Choi et al.
10,144,555 B2 12/2018 Ayres et al.
D836,982 S 1/2019 Diener et al.
10,165,879 B2 1/2019 Davies et al.
D849,481 S 5/2019 Washburn
10,336,510 B2 7/2019 El-Saden et al.
D862,985 S 10/2019 Backs
10,455,959 B2 10/2019 Coon et al.
10,479,585 B2 11/2019 Seiders et al.
D872,522 S 1/2020 Diener et al.
10,524,597 B2 1/2020 Sorensen et al.
10,542,833 B2 1/2020 Davies et al.
D876,905 S 3/2020 Seiders et al.
D887,214 S 6/2020 Bujalska
D887,776 S 6/2020 Bo
10,676,255 B2 6/2020 Choi et al.
10,687,643 B2 * 6/2020 Cheng ..... A47G 19/2266
D899,859 S 10/2020 Jacobsen
D899,870 S 10/2020 Seiders et al.
D899,871 S 10/2020 Seiders et al.
D906,042 S 12/2020 Chen
10,898,017 B2 1/2021 Kalisz et al.
D911,100 S 2/2021 Chen et al.
2017/0119212 A1 5/2017 Petrillo et al.
2018/0078093 A1 3/2018 Petrillo et al.
2019/0183269 A1 6/2019 Kalisz et al.
2019/0344934 A1 11/2019 Faerber et al.
2019/0357711 A1 11/2019 Nichols et al.
2019/0389644 A1 12/2019 Tolman et al.
2020/0337484 A1 10/2020 Sorensen et al.

* cited by examiner

WATER BOTTLE

CROSS-REFERENCE AND CLAIM OF PRIORITY

This patent application claims priority to U.S. Provisional Patent Application No. 63/229,291 filed Aug. 4, 2021, which is incorporated herein by reference in its entirety.

BACKGROUND

Water bottles can have different drinking configurations. For example, some water bottles can have configurations that allow a user to "chug" from an opening in a bottle. In these configurations, the bottle can have a threaded lid that the user removes before drinking, chug-style, by partially inverting the bottle. Alternatively, the bottle can have an actuator, which hingedly opens the lid to reveal the opening in the container.

Other water bottles are configured to allow a user to "sip" from the bottle. In these configurations, a straw typically engages with the lid. The user can sip from the straw without partially inverting the bottle. Some sip-style bottles have lids that cover the straw. Other sip-style bottles have a mouthpiece that can move from a closed configuration to a "sip" configuration.

However few products provide both chug and sip configurations. Some bottles have a "chug" lid that is separate from a "sip" mouthpiece. But these products do not allow the user to easily switch between chug and sip configurations. Other bottle configurations have a single spout that has sip and chug openings. But these products do not allow a user to switch between sip and chug configurations. This document describes water bottles that are directed to addressing the problems described above, and/or other issues.

DETAILED DESCRIPTION

This disclosure describes various water bottle designs that are configured to convert from a closed configuration to an open chug configuration or an open sip configuration. When the water bottle is in its open chug configuration, a user may drink or otherwise dispense liquid through an opening in the water bottle by at least partially inverting the bottle. When the water bottle is in its open sip configuration, a user may drink liquid by sipping the liquid through a straw without inverting the bottle. When the water bottle is in its closed configuration, liquid remains substantially within the bottle, even if the bottle is inverted.

Figure 1:
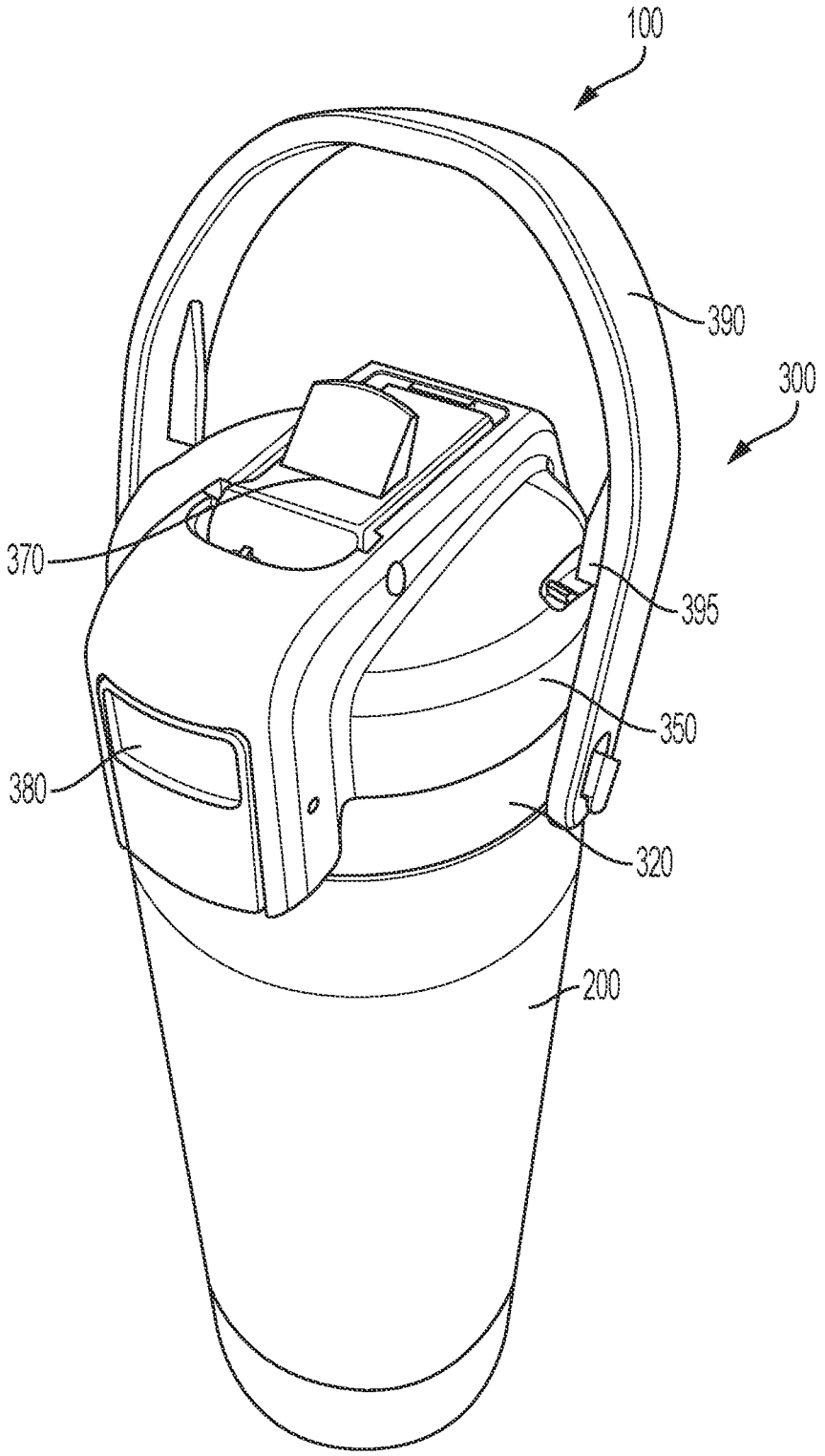
FIG. 1 shows a perspective view of an example water bottle in a closed configuration.
Figure 2:
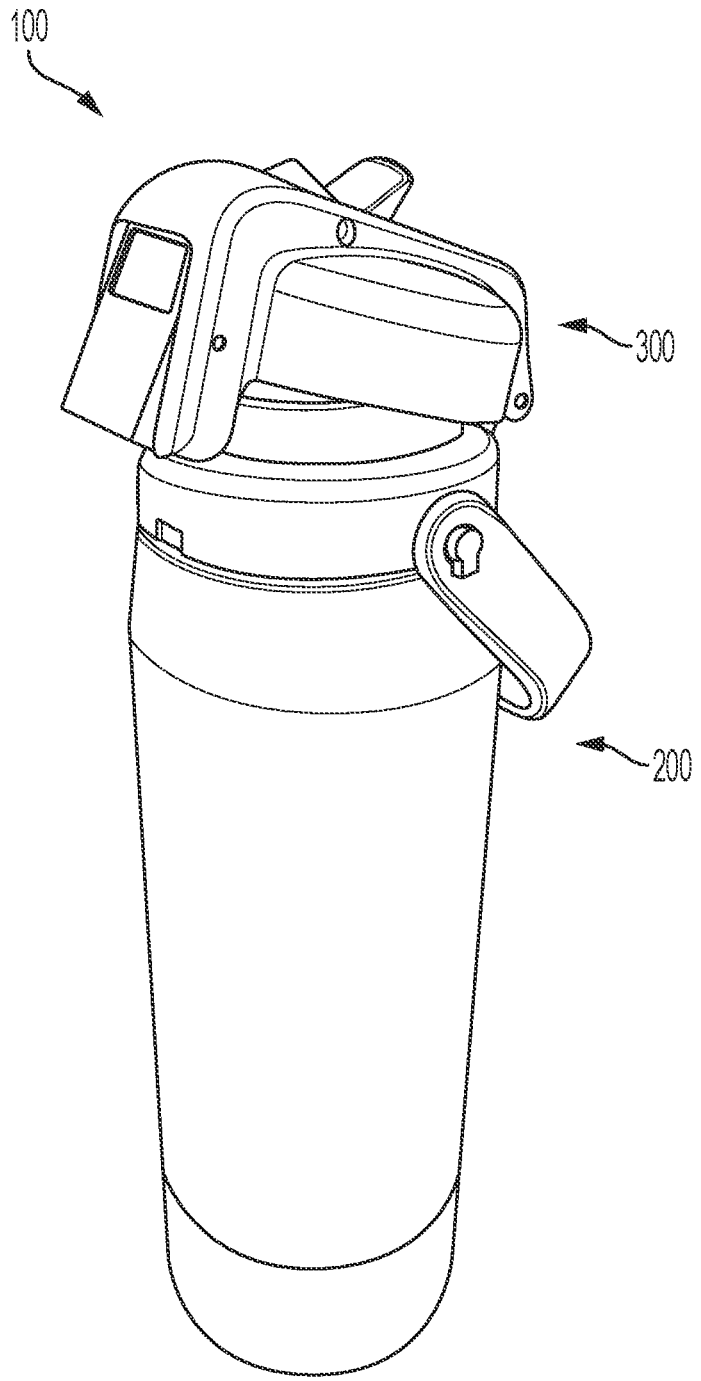
FIG. 2 shows a perspective view of an example water bottle in a partially open chug configuration.
Figure 4:
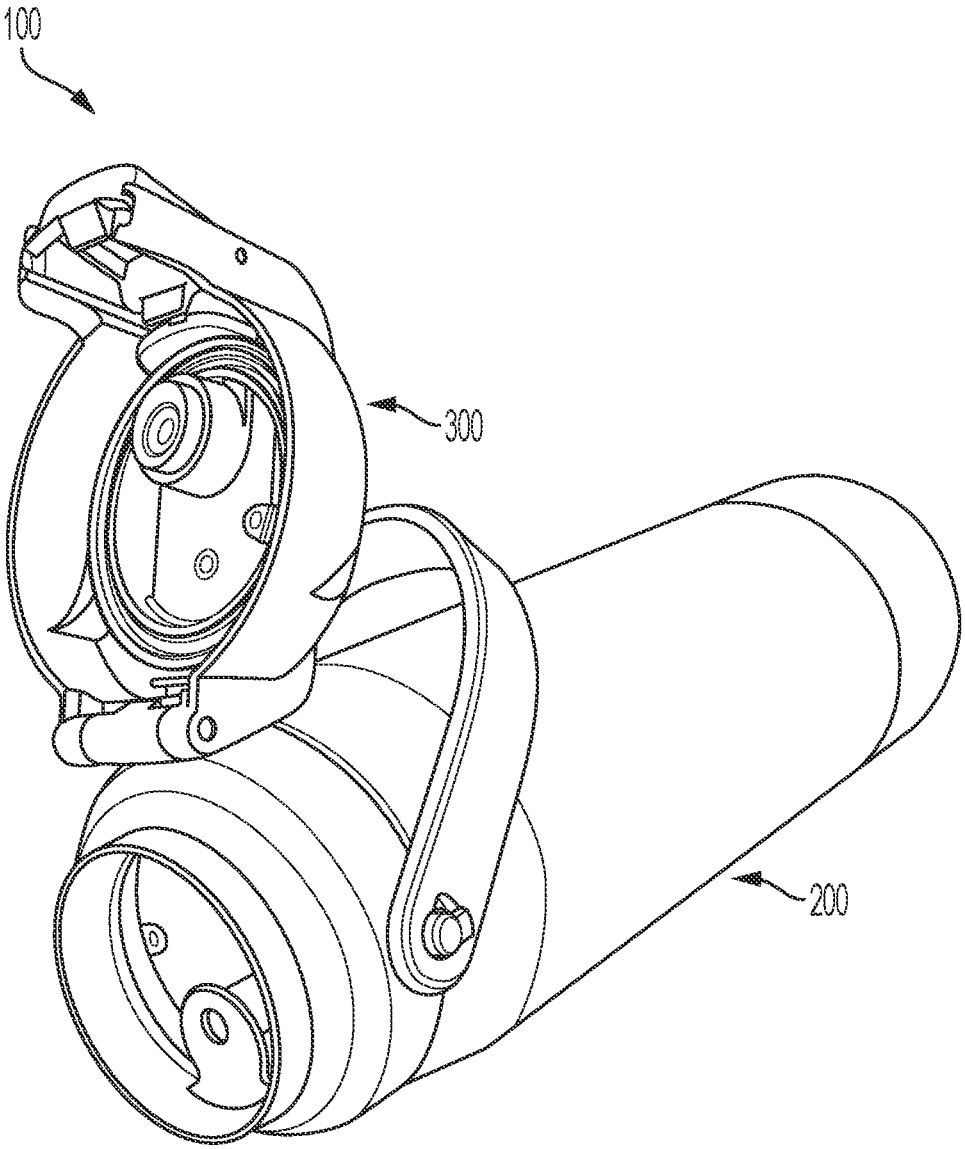
FIG. 4 shows a perspective view of an example water bottle in an open chug configuration.

In various embodiments, as shown in FIGS. 1, 2 and 4, a water bottle 100 may have a reservoir 200 and a lid 300. The reservoir 200 may be substantially cylindrical, although other shapes may be used within the scope of this disclosure. The reservoir 200 may have a closed bottom. The reservoir 200 may have an open top. As such, the reservoir 200 may define a space that can hold a liquid when the water bottle 100 is in an upright position. The reservoir 200 may have a reservoir threaded portion located at the top outer rim of the reservoir. The lid 300 may be substantially cylindrical, although other shapes may be used within the scope of this disclosure. The lid 300 may have a top and a bottom. In various embodiments, the lid 300 may have a lid threaded portion located at the bottom inner rim of the lid. Alternatively, the reservoir threaded portion may be located at the top inner rim of the reservoir 200, and the lid threaded portion may be at the bottom out rim of the lid 300. The lid threaded portion may engage with the reservoir threaded portion to attach the lid to the reservoir.

Figure 3:
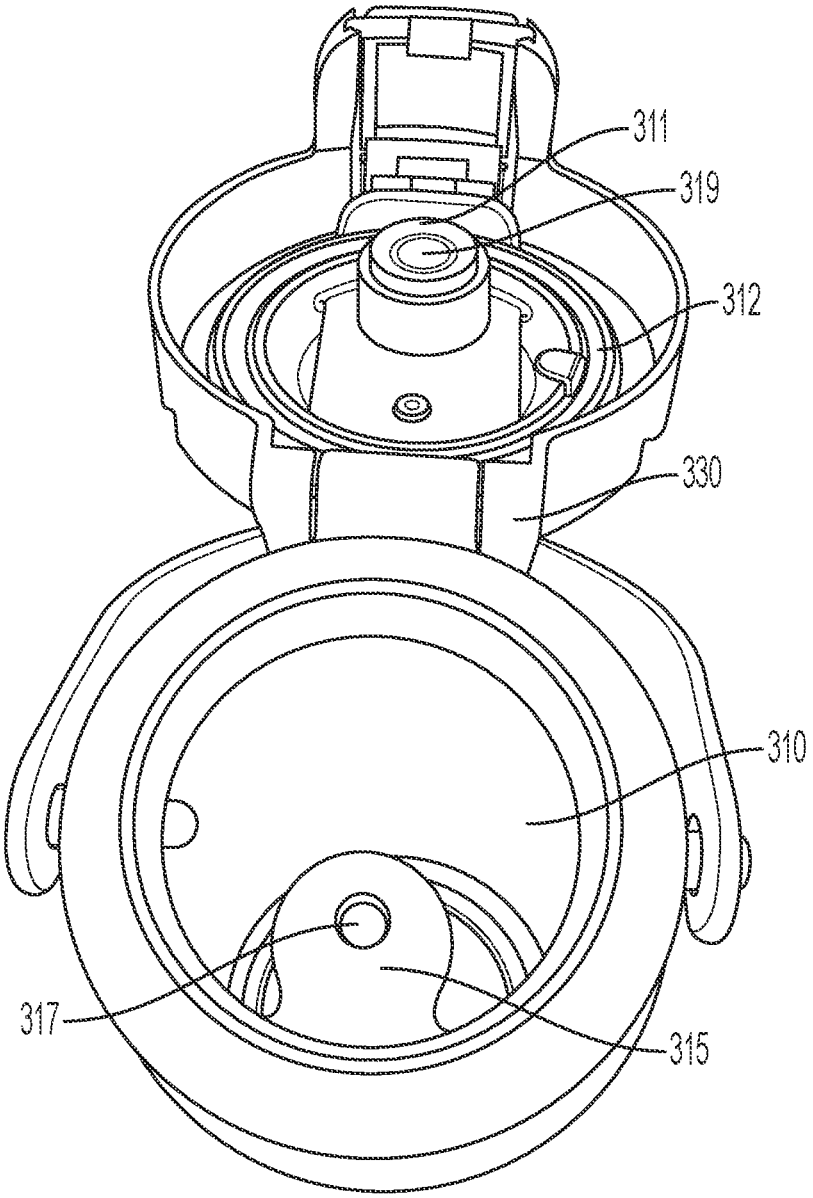
FIG. 3 shows a top view of an example water bottle in an open chug configuration.

The lid 300 may have a lower lid portion 320 and an upper lid portion 350. The lower lid portion 320 and upper lid portion 350 may each be substantially disk shaped. The lower lid portion 320 and upper lid portion 350 may have a top and bottom side. The bottom of the upper lid portion 350 may be configured to engage with the top of the lower lid portion 320. When the upper lid portion 350 and the lower lid portion 320 are engaged, the interface between the upper lid portion and the lower lid portion may form a substantially liquid impermeable interface. The lower lid portion 320 may be partially connected to the upper lid portion 350. In various embodiments, the lower lid portion 320 may be partially connected to the upper lid portion 350 by a hinge 330, as illustrated in FIG. 3. The upper lid portion 350 may rotate about the hinge 330 with respect to the lower lid portion 320. As such, the upper lid portion 350 may hingedly rotate from a closed configuration (as shown in FIG. 1) to an open chug configuration (as shown in FIGS. 3 and 4). It is understood that the upper lid portion 350 and the lower lid portion 320 may be connected in one or more alternative ways.

The lower lid portion 350 may have a threaded portion located on the inner side of the bottom of the lower lid portion 320. As such, the lower lid portion may directly engage with a reservoir 200. The lower lid portion 320 may have a first opening 310, as illustrated in FIG. 3. The first opening 310 may be configured to allow a user to drink or otherwise dispense liquid through the first opening. The lower lid portion 350 may have a straw engagement member 315 that extends at least partially into the first opening 310. The straw engagement portion 315 may have a second opening 317. The straw engagement portion 315 may be configured to releasably engage with a straw 313 (see FIG. 6). The straw 313 may engage with the bottom side of the straw engagement portion 315 such that the straw may extend at least partially into the reservoir 200 when the lid 300 is engaged with the reservoir. The straw 313 may be in fluid connection with the second opening 317.

The upper lid portion 350 may have an actuator 380 which may allow the upper lid portion 350 to be temporarily held in the closed configuration. The actuator 380 may temporarily connect to the lower lid portion 320. For example, the actuator 380 may have a latch that engages with the lower lid portion 320, preventing the upper lid portion 350 from moving with respect to the lower lid portion. When the actuator 380 is engaged (e.g. pressed), the upper lid portion 350 may disengage from the lower lid portion 320. For example, when the actuator 380 is engaged, it may cause the latch to release from the lower lid portion 320.

The water bottle 100 may have a handle 390. The handle 390 may be substantially U-shaped, having two free ends. The free ends of the handle 390 may hingedly engage with the lower lid portion 320. As such, the handle 390 may be rotated through various positions, enabling a user to carry the bottle. The handle 390 may also be rotated such that the handle is horizontal, enabling a user to drink or dispense fluid from the water bottle. The interior side of the handle 390 may have one or more blocks 395 configured to contact the upper lid portion 350 when the handle 390 is in its upright configuration.

FIG. 3 shows that the upper lid portion 350 may have a third opening 319. The third opening 319 may be an aperture that passes through the body of the upper lid portion 350. The third opening 319 may be configured such that it is in fluid communication with the second opening 317 when the water bottle is in the closed configuration. The water bottle may have a straw seal 311. The straw seal 311 may be positioned between the upper lid portion 350 and the lower lid portion 320 as to enhance the fluid communication between the second opening 317 and the third opening 319.

Figure 5:
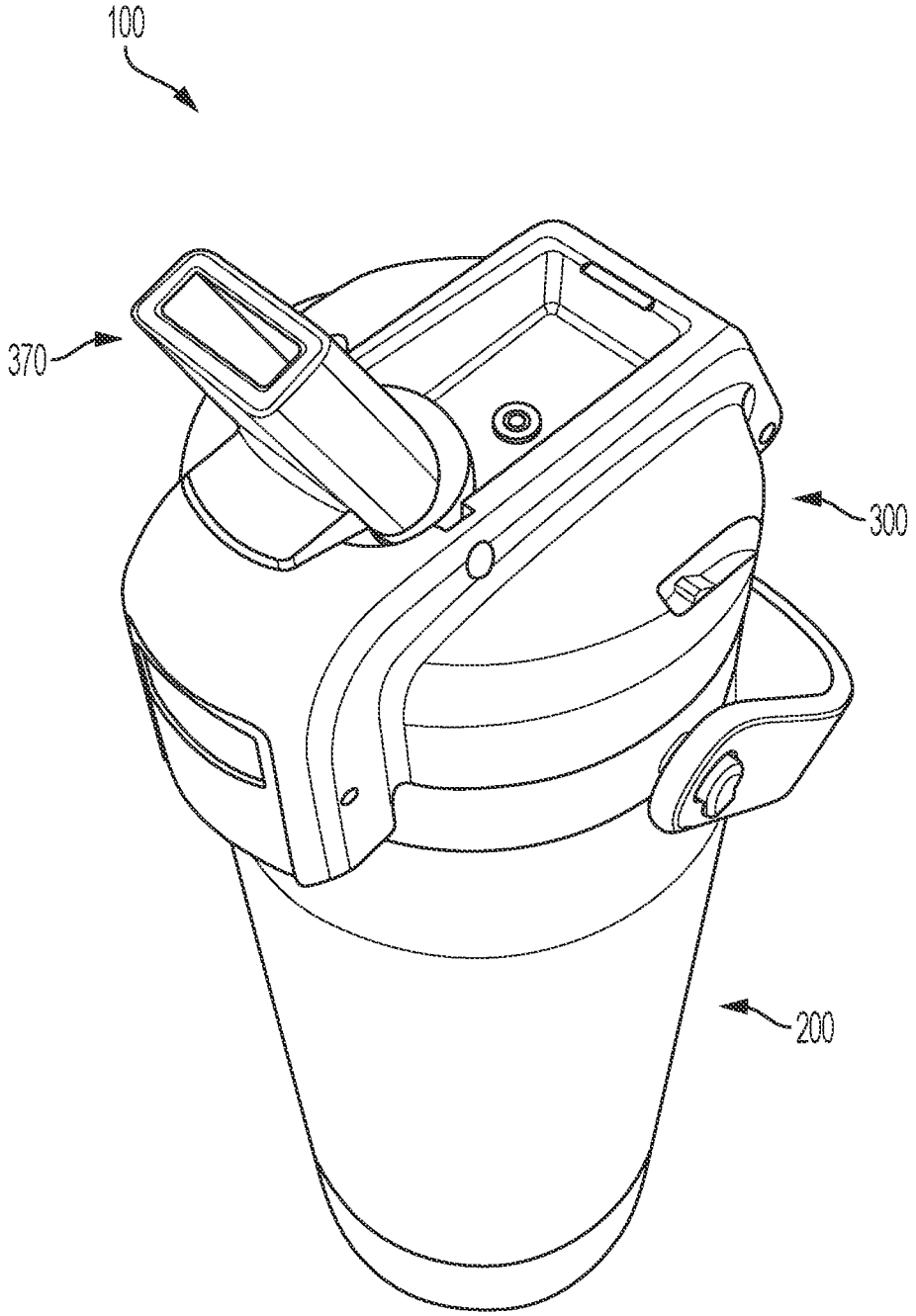
FIG. 5 shows a perspective view of an example water bottle in an open sip configuration.

The water bottle 100 may have a mouthpiece 370. The mouthpiece 370 may be hingedly attach to the upper lid portion 350. The mouthpiece 370 may be a fluid conduit. The fluid within the mouthpiece 370 may flow substantially along the length of the mouthpiece. When the water bottle is in its closed configuration (as shown in FIG. 1), the length of the mouthpiece 370 may be substantially perpendicular to the vertical axis of the water bottle. When the water bottle is in its open sip configuration (as shown in FIG. 5), the length of the mouthpiece 370 may be substantially parallel to the vertical axis of the water bottle. In the open sip configuration, the mouthpiece 370 may be in fluid communication with the third opening 319. In the closed configuration, the mouthpiece 370 may not be in fluid communication with the third opening 319.

Figure 6:
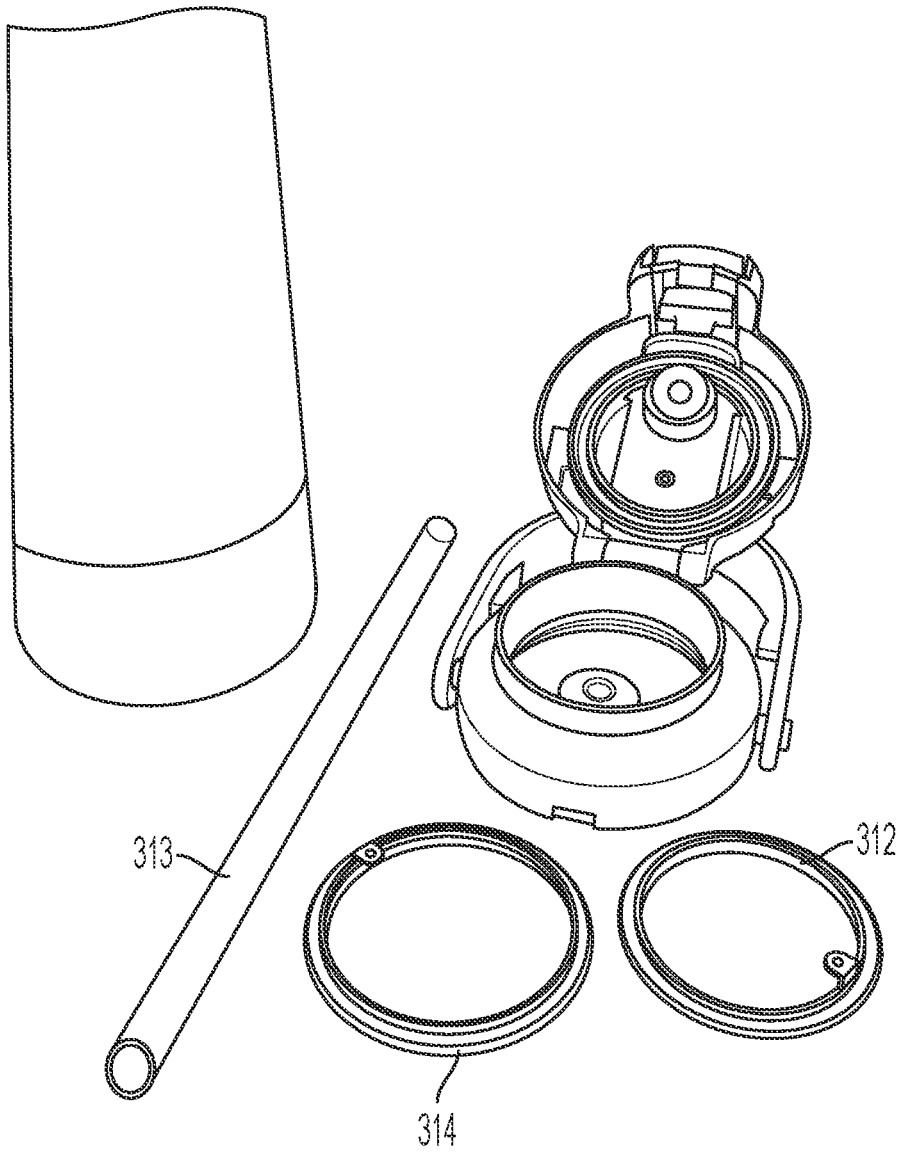
FIG. 6 shows separate components of an example water bottle.

In various embodiments, the water bottle 100 may have at least one seal. For example, as shown in FIG. 6, the water bottle 100 may have a lower seal 314. The lower seal 314 may be located at the interface between the reservoir 200 and the lid 300. The lower seal 314 may function to prevent leaks between the reservoir 200 and the lid. In various embodiments, the water bottle 100 may have an upper seal 312. The upper seal 312 may be located at the interface between the upper lid portion 350 and the lower lid portion 320. The upper seal 312 may function to prevent leaks between the upper lid portion 350 and the lower lid portion 320.

Figure 7:
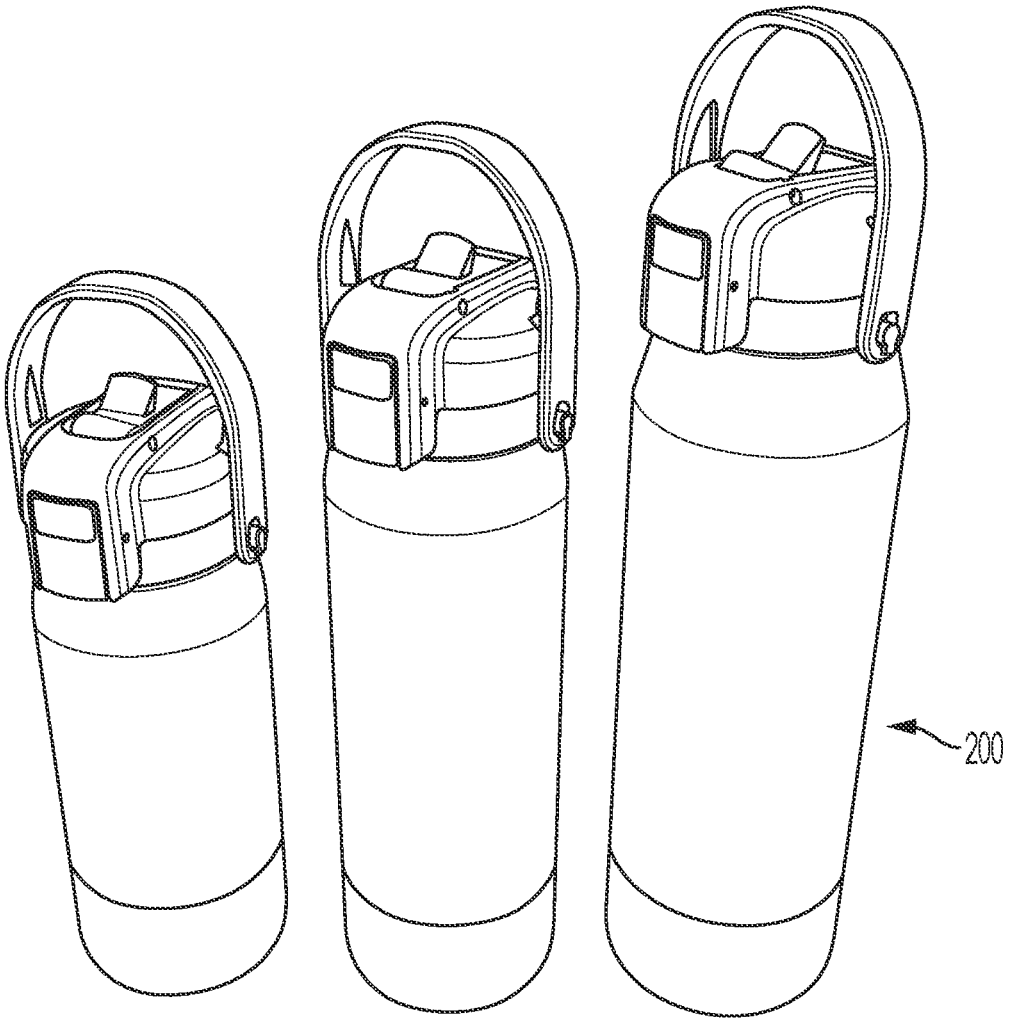
FIG. 7 shows perspective views of three different sizes of example water bottles.

In various embodiments, the water bottle 100 may be configured to hold different amounts of water. For example, as shown in FIG. 7, the water bottle may have a reservoir 200 that can hold different quantities of liquid. For example, the reservoir 200 may be configured to hold 18 ounces, 24 ounces, or 32 ounces of liquid, although other fluid volumes are within the scope of this disclosure.

The invention claimed is:

1. A water bottle comprising:

a reservoir that defines a space for holding a liquid, wherein the reservoir comprises an open top and a closed bottom;

a lid that engages with the reservoir over the open top;

a straw; and a pivotable mouthpiece that is attached to the lid and that comprises a fluid conduit that is fluidly connected to the straw, wherein:

the lid comprises an upper lid portion having an upper seal and a lower lid portion having a lower seal connected by a hinge, the upper lid portion may rotate away from the lower lid portion via the hinge, and when the upper lid portion and the lower lid portion are engaged, a substantially liquid impermeable interface is formed between the upper seal of the upper lid portion and the lower seal of the lower lid portion.

2. The water bottle of claim 1, wherein the lower lid portion further comprises:

a first opening;

a straw engagement member that extends at least partially into the first opening, and which comprises a second opening configured to engage with the straw to position the straw to extend at least partially into the reservoir.

3. The water bottle of claim 1, wherein:

the pivotable mouthpiece is attached to the upper lid portion; and when the water bottle is in an open sip configuration, the pivotable mouthpiece will be in fluid communication with the second opening; and when the water bottle is in a closed configuration, the pivotable mouthpiece will not be in fluid communication with the second opening.

4. The water bottle of claim 3, wherein:

when the water bottle is in the open sip configuration, a longest section of the mouthpiece will be positioned upward from the water bottle; and when the water bottle is in the closed configuration, the pivotable mouthpiece will be stowed on the upper lid portion of the water bottle.

5. The water bottle of claim 3, wherein the straw is fluidly connected to the second opening when the second opening is engaged with the straw.

6. The water bottle of claim 5, wherein:

the upper lid portion comprises a third opening that is configured to be in fluid communication with the second opening when the upper lid portion is engaged with the lower lid portion; and the water bottle further comprises a straw seal that is positioned between the upper lid portion and the lower lid portion to enhance the fluid communication between the third opening and the second opening.

7. The water bottle of claim 1, wherein the upper lid portion further comprises an actuator that:

when engaged with the lower lid portion while the upper lid portion is in a closed configuration, will prevent the upper lid portion from moving with respect to the lower lid portion and when pressed, will disengage the upper lid portion from the lower lid portion.

8. The water bottle of claim 1, further comprising a handle having ends that are hingedly engaged with the lower lid portion.

9. The water bottle of claim 1, wherein:

a top outer rim of the reservoir comprises a threaded portion; and a bottom inner rim of the lid also comprises a threaded portion that is configured to engage with the threaded portion of the reservoir.

10. A water bottle comprising:

a reservoir that defines a space for holding a liquid, wherein the reservoir comprises an open top and a closed bottom;

a lid that is configured to engage with the reservoir over the open top, wherein the lid comprises:

an upper lid portion having an upper seal, a lower lid portion having a lower seal and that is configured to partially connect to the upper lid portion by a hinge, wherein when the upper lid portion and the lower lid portion are engaged, the upper seal and the lower seal form a substantially liquid impermeable interface between the upper lid portion and the lower lid portion, a straw; and a pivotable mouthpiece that is attached to the upper lid portion and that comprises a fluid conduit that is fluidly connected to the straw.

11. The water bottle of claim 10, wherein the lower lid portion further comprises:

a first opening;

a straw engagement member that extends at least partially into the first opening, and which comprises a second opening configured to engage with the straw to position the straw to extend at least partially into the reservoir.

12. The water bottle of claim 10, wherein:

the pivotable mouthpiece is attached to the upper lid portion; and when the water bottle is in an open sip configuration, the pivotable mouthpiece will be in fluid communication with the second opening; and when the water bottle is in a closed configuration, the pivotable mouthpiece will not be in fluid communication with the second opening.

13. The water bottle of claim 12, wherein:

when the water bottle is in the open sip configuration, a longest section of the mouthpiece will be positioned substantially parallel to a vertical axis of the water bottle; and when the water bottle is in the closed configuration, the pivotable mouthpiece will be positioned to be not substantially parallel to the vertical axis of the water bottle.

14. A water bottle comprising:

a reservoir that defines a space for holding a liquid, wherein the reservoir comprises an open top and closed bottom;

a straw; and a lid that engages with the reservoir over the open top, the lid comprising an upper lid portion and a lower lid portion that are axially aligned, wherein:

the lower lid portion comprises a first opening, and a straw engagement member that extends at least partially into the first opening and which comprises a second opening configured to engage with the straw to position the straw to extend at least partially into the reservoir, and the upper lid portion comprises a pivotable mouthpiece that comprises a fluid conduit that is fluidly connected to the straw via the second opening of the straw engagement member.

15. The water bottle of claim 14, wherein:

the lower lid portion comprises a hinge to at least partially connect the lower lid portion to the upper lid portion;

the upper lid portion may rotate away from the lower portion via the hinge; and when the upper lid portion and the lower lid portion are engaged, a substantially liquid impermeable interface is formed between the upper lid portion and the lower lid portion.

16. The water bottle of claim 14, wherein the upper lid portion further comprises an actuator that:

when engaged with the lower lid portion while the upper lid portion is in a closed configuration, will prevent the upper lid portion from moving with respect to the lower lid portion and when pressed, will disengage the upper lid portion from the lower lid portion.

17. The water bottle of claim 14, wherein the straw engagement member comprises a seal.

18. The water bottle of claim 14, further comprising a handle having blocks configured to lock the handle in an upright position.

19. A water bottle comprising:

a reservoir that defines a space for holding a liquid, wherein the reservoir comprises an open top and closed bottom;

a straw;

a lid that engages with the reservoir over the open top, the lid comprising an upper lid portion and a lower lid portion, wherein:

the lower lid portion comprises a first opening, and a straw engagement member that extends at least partially into the first opening and which comprises a second opening configured to engage with the straw to position the straw to extend at least partially into the reservoir, the upper lid portion comprises a pivotable mouthpiece that comprises a fluid conduit that is fluidly connected to the straw via the second opening of the straw engagement member; and an actuator on the upper lid portion that will prevent the upper lid portion from moving with respect to the lower lid portion, and when pressed will disengage the upper lid portion from the lower lid portion.

20. The water bottle of claim 19, wherein:

the lower lid portion comprises a hinge to at least partially connect the lower lid portion to the upper lid portion;

the upper lid portion may rotate away from the lower portion via the hinge; and when the upper lid portion and the lower lid portion are engaged, a substantially liquid impermeable interface is formed between the upper lid portion and the lower lid portion.

* * * * *